US010946947B1

(12) United States Patent
Tseng

(10) Patent No.: US 10,946,947 B1
(45) Date of Patent: Mar. 16, 2021

(54) OAR CAPABLE OF BAILING WATER

(71) Applicant: Chuan Jiing Enterprise Co., Ltd., Taichung (TW)

(72) Inventor: Tien Tsai Tseng, Taichung (TW)

(73) Assignee: Chuan Jiing Enterprise Co., Ltd., Taichung (TW)

( * ) Notice: Subject to any disclaimer, the term of this patent is extended or adjusted under 35 U.S.C. 154(b) by 8 days.

(21) Appl. No.: 16/683,481

(22) Filed: Nov. 14, 2019

(51) Int. Cl.
*B63H 16/04* (2006.01)
*B63B 13/00* (2006.01)

(52) U.S. Cl.
CPC ..... *B63H 16/04* (2013.01); *B63B 13/00* (2013.01)

(58) Field of Classification Search
CPC ..... B63H 16/04; B63B 13/00
See application file for complete search history.

(56) References Cited

U.S. PATENT DOCUMENTS 5,163,778 A * 11/1992 Botero ..... B63B 13/00 114/221 R
5,322,462 A * 6/1994 Hull ..... B63H 16/04 114/221 R
5,902,162 A * 5/1999 Kot ..... B63H 16/04 114/221 R
6,027,386 A * 2/2000 Hains ..... B63B 13/00 114/221 R
6,537,117 B1 * 3/2003 Larson ..... B63H 16/04 416/70 R
6,857,922 B2 * 2/2005 Fernandez ..... B63H 16/102 440/101
9,376,176 B1 * 6/2016 Holden ..... B63B 32/00
9,440,721 B2 * 9/2016 Marino ..... B63B 32/00
10,266,232 B1 * 4/2019 Colten ..... A45F 4/10
2013/0266442 A1 * 10/2013 Lass ..... B63H 16/04 416/1
2014/0187108 A1 * 7/2014 Prade ..... B63H 16/04 440/104
2016/0200411 A1 * 7/2016 Marino ..... B63B 32/00 440/101
2016/0200412 A1 * 7/2016 Tsuei ..... B63H 16/04 440/101
2018/0352794 A1 * 12/2018 Shiflett, Jr. ..... A01K 97/10

* cited by examiner

*Primary Examiner* — S. Joseph Morano
*Assistant Examiner* — Jovon E Hayes
(74) *Attorney, Agent, or Firm* — Thomas J. Nikolai; DeWitt LLP

(57) ABSTRACT

An oar capable of bailing water includes a rod and an oar blade disposed at one end of the rod. The rod includes an outer tube and an inner tube that are insertedly connected to each other to form a pump structure capable of performing a telescopic movement. A fixing device is provided at the junction of the outer tube and the inner tube. The rod has an accommodating room therein. The accommodating room is provided with a piston that can slide along the accommodating room with the telescopic movement of the rod. Another end of the rod, opposite to the oar blade, is formed with a bail opening. A passage is defined between the bail opening and the accommodating room to communicate with each other, so that the bail opening can bail water when the piston is moved.

7 Claims, 7 Drawing Sheets

OAR CAPABLE OF BAILING WATER

FIELD OF THE INVENTION

The present invention relates to an oar, and more particularly to an oar capable of bailing water.

BACKGROUND OF THE INVENTION

An oar is a device used for propelling a boat to go manually. In order to improve the practicability of oars, U.S. Pat. Nos. 5,163,778, 5,322,462, and 6,027,386 disclose an oar capable of bailing water. The rod of the oar is designed as a pump structure for performing a telescopic movement. A bail hole is disposed near the end of the oar blade. The combination of the pump structure and the bail hole of the rod enables the oar to have the function of bailing water.

However, when the oar provided by these patents is used to row or steer a boat through the water and if there is water in the boat, the oar needs to be lifted upward for the oar blade to leave the water surface, and then the oar blade is placed in the boat for bailing water. Since the oar has a certain length and the boat is easy to shake, it is no easy to operate the oar. Moreover, since the oar blade has a large width, it is difficult to be placed onto the boat's floor. The bail hole is disposed at the end of the oar blade, which is not easy to bail water. When the oar is used to bail water, it is necessary to place the end of the oar blade onto the boat's floor. This leads to a restriction on the direction of use.

Accordingly, the inventor of the present invention has devoted himself based on his many years of practical experiences to solve these problems.

SUMMARY OF THE INVENTION

The primary object of the present invention is to provide an oar capable of bailing water. The oar has a bail opening that is disposed at one end of the oar opposite an oar blade. The oar can be operated conveniently and can bail water easily.

In order to achieve the above object, an oar capable of bailing water is provided. The oar comprises a rod and an oar blade that is flared and connected to one end of the rod. The rod includes an outer tube and an inner tube that are insertedly connected to each other to form a pump structure capable of performing a telescopic movement. A fixing device is provided at the junction of the outer tube and the inner tube. The rod has an accommodating room therein. The accommodating room is provided with a piston that can slide along the accommodating room with the telescopic movement of the rod. Another end of the rod, opposite to the oar blade, is formed with a bail opening communicating with the outside. A passage is defined between the bail opening and the accommodating room. The passage communicates with the bail opening and the accommodating room.

Preferably, the other end of the rod, opposite to the oar blade, is provided with a grip. The grip has a protruding portion extends laterally. The bail opening is formed on an end face of the protruding portion facing an extending direction of the protruding portion. The passage is bent and disposed inside the grip to communicate with the bail opening and the accommodating room.

DETAILED DESCRIPTION OF THE PREFERRED EMBODIMENTS

Embodiments of the present invention will now be described, by way of example only, with reference to the accompanying drawings.

Figure 1:
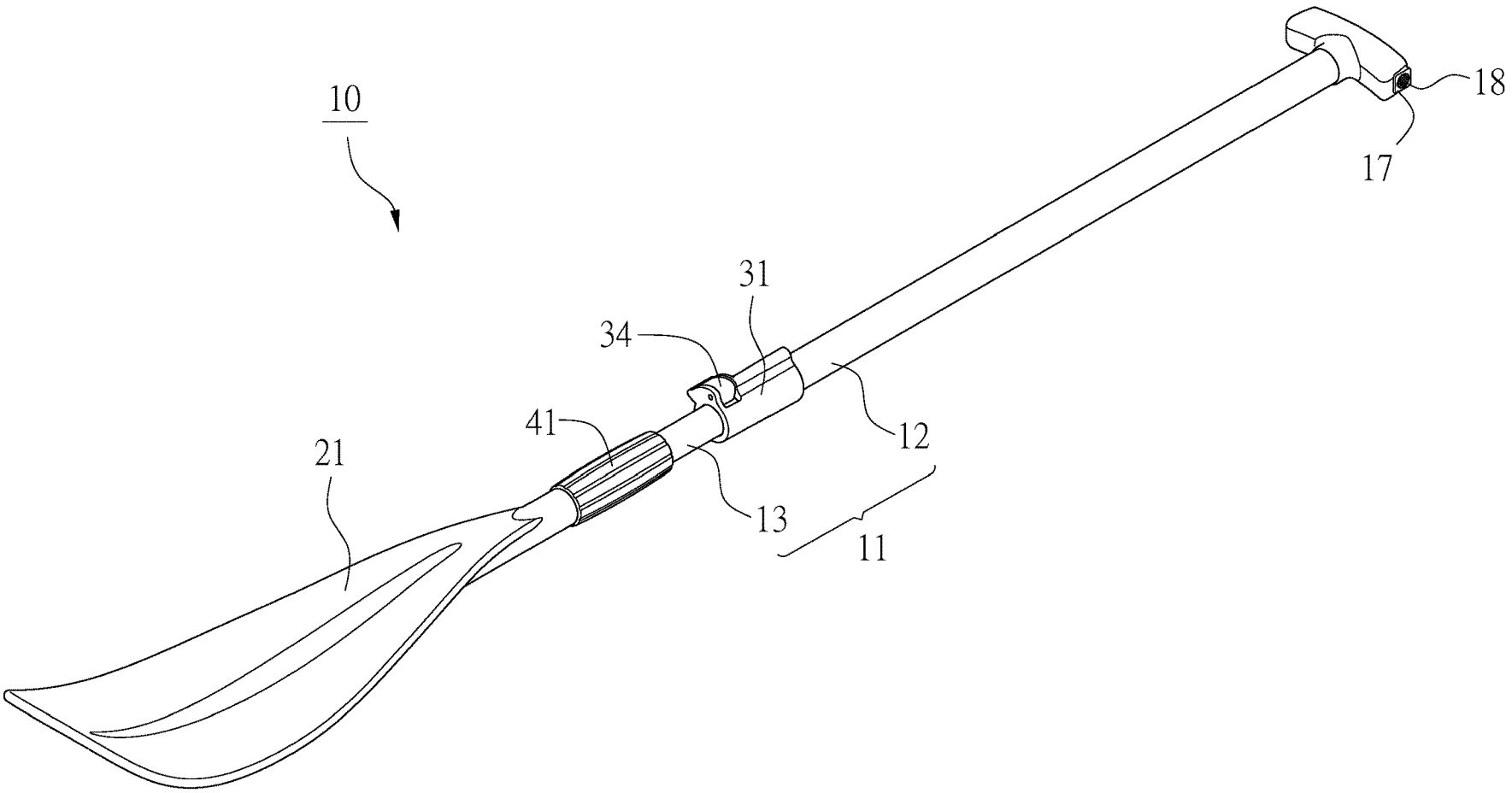
FIG. 1 is a perspective view of the present invention.
Figure 2:
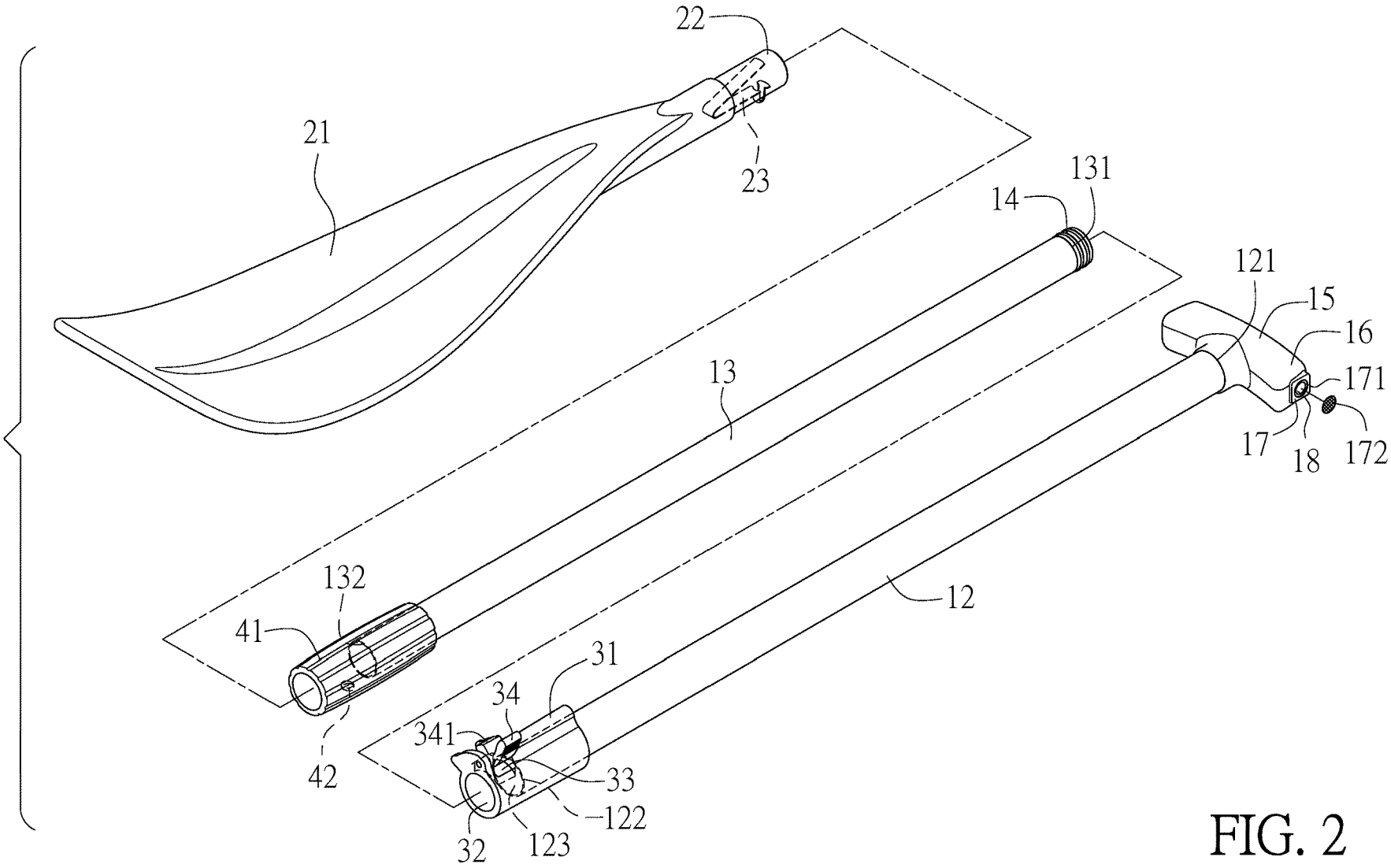
FIG. 2 is an exploded view of the present invention.
Figure 3:
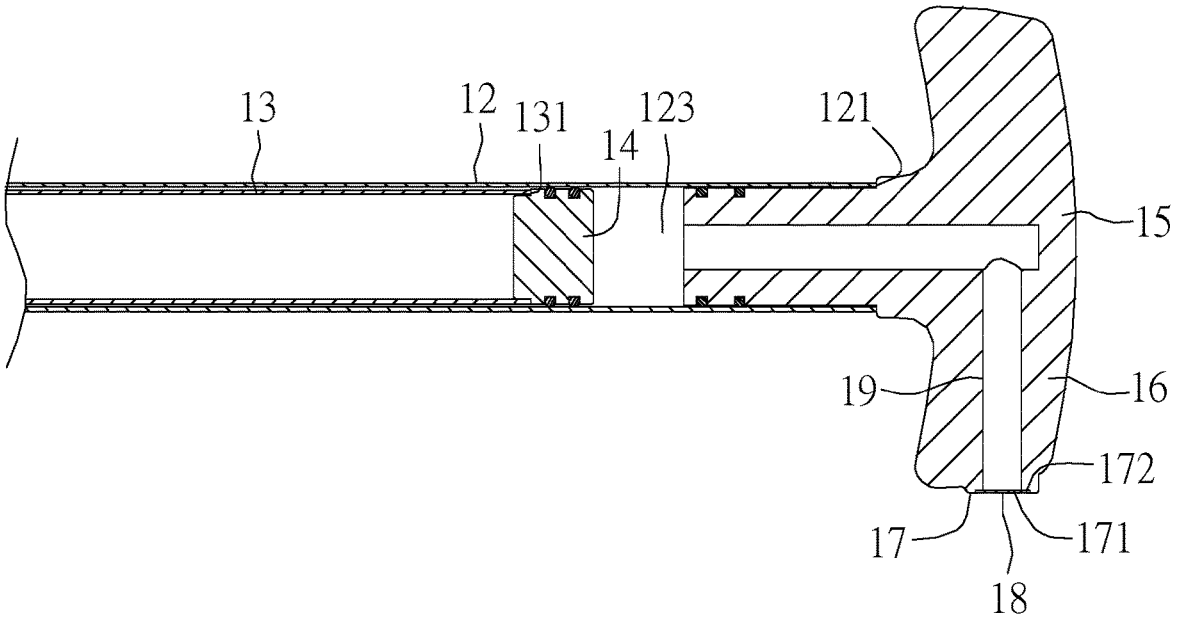
FIG. 3 is a cross-sectional view of the handle of the present invention.

First, referring to the FIGS. 1-3, an oar 10 capable of bailing water according to an embodiment of the present invention comprises a rod 11 and an oar blade 21 disposed at one end of the rod 1.

The rod 11 includes an outer tube 12 and an inner tube 13 that are insertedly connected to each other to form a pump structure capable of performing a telescopic movement. Another end of the rod 11, opposite to the oar blade 21, is formed with a bail opening 18. In this embodiment, the outer tube 12 has a hollow tubular shape with two open ends defined as a coupling end 121 and a receiving end 122. The outer tube 12 has an accommodating room 123 therein. The inner tube 13 has a first end 131 and a second end 132. The first end 131 of the inner tube 13 is slidably inserted into the accommodating room 123 via the receiving end 122 of the outer tube 12. The first end 131 is provided with a piston 14 which closely abuts against the inner wall of the accommodating room 123, so that the piston 14 slides along the accommodating chamber 123 with the inner tube 13. A grip 15 is connected to the coupling end 121 of the outer tube 12. The grip 15 has a protruding portion 16. The protruding portion 16 extends in a lateral direction that is perpendicular to an axial direction of the rod 11. The lateral direction is preferably the direction in which the oar 10 is oriented toward the user when oar 10 is used to row or steer a boat through the water. The bail opening 18 is formed on an end face 17 of the protruding portion 16 facing an extending direction of the protruding portion 16. The inside of the grip 15 is formed with an L-shaped bent passage 19 communicating with the bail opening 18 and the accommodating room 123. In practical applications, the passage 19 is constituted by a hose disposed inside the grip 15.

Figure 4:
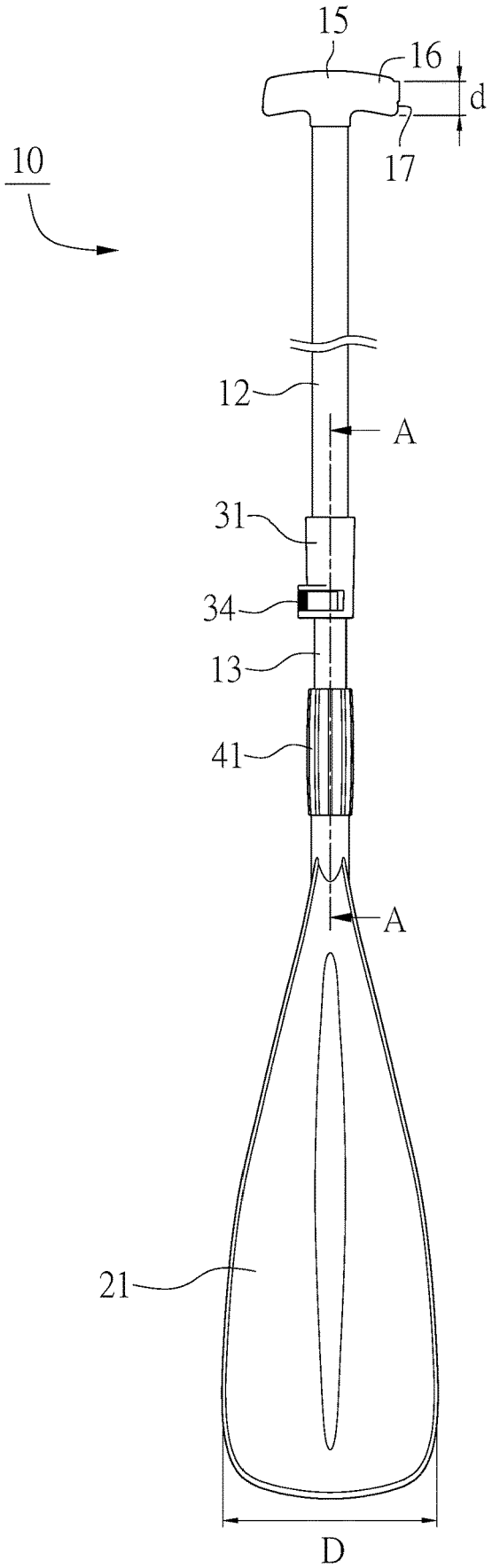
FIG. 4 is a planar view of the present invention.
Figure 5:
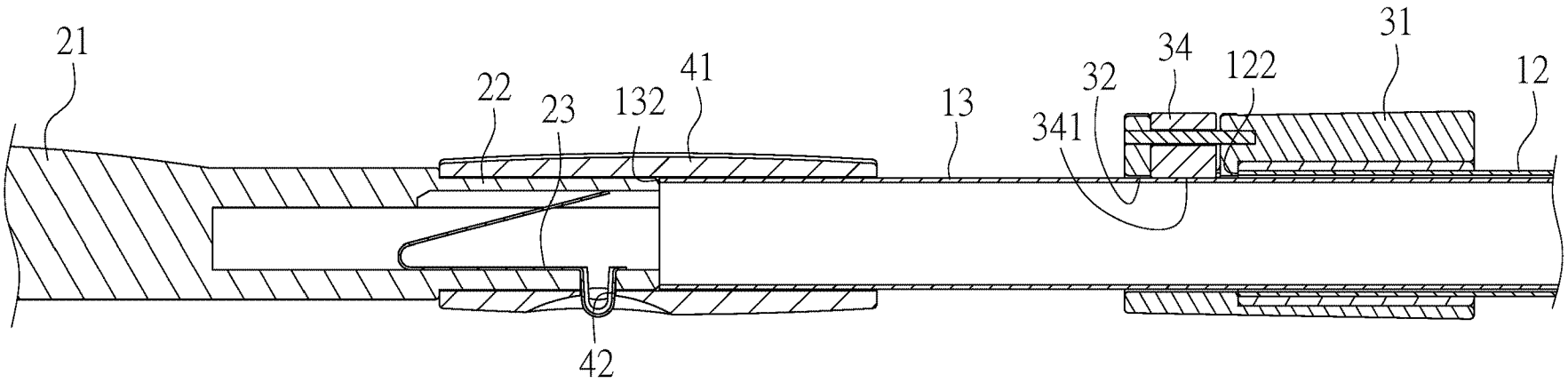
FIG. 5 is a cross-sectional view taken along line A-A of FIG. 4.

Preferably, the end face 17 is recessed to form an annular groove 171 at a position corresponding to the periphery of the bail opening 18. The annular groove 171 is provided with a mesh filter 172 for covering the bail opening 18. A fixing device 31 is disposed on the receiving end 122 of the outer tube 12. Referring to FIG. 4 and FIG. 5, the fixing device 31 has an extension interface 32 that is coaxially disposed with the receiving end 122. The first end 131 of the inner tube 13 is inserted into the accommodating room 123 via the extension interface 32 and the receiving end 122 of the outer tube 12. The fixing device 31 is formed with a groove 33 communicating with the extension interface 32. A positioning member 34 is pivotally connected to the groove 33. One end of the positioning member 34 is formed with an abutting portion 341 that is pivotal to press against the outer circumferential surface of the inner tube 13, so that the inner tube 13 can be pressed by the abutting portion 341 to be in a retaining state and cannot be telescopically moved relative to the outer tube 12.

Furthermore, the second end 132 of the inner tube 13 is coaxially connected with a hollow sleeve 41. The sleeve 41 is formed with a positioning hole 42 along a radial direction thereof. The oar blade 21 is flared. One end of the oar blade 21 is formed with a joint portion 22 that is inserted into the sleeve 41. The joint portion 22 is provided with a resilient member 23 that is resiliently engaged with the positioning hole 42, so that the oar blade 21 is detachably connected to the second end 132 of the inner tube 13, thereby assembling the oar 10 of the present invention.

Figure 7:
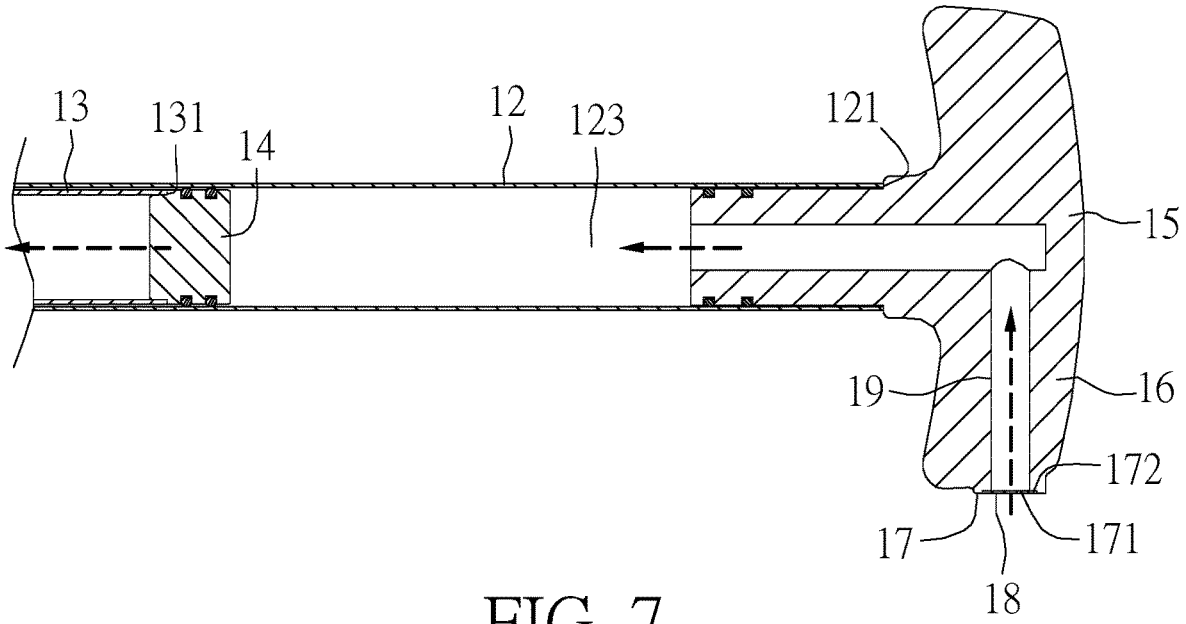
FIG. 7 is a schematic view of the present invention in a bailing state.
Figure 6:
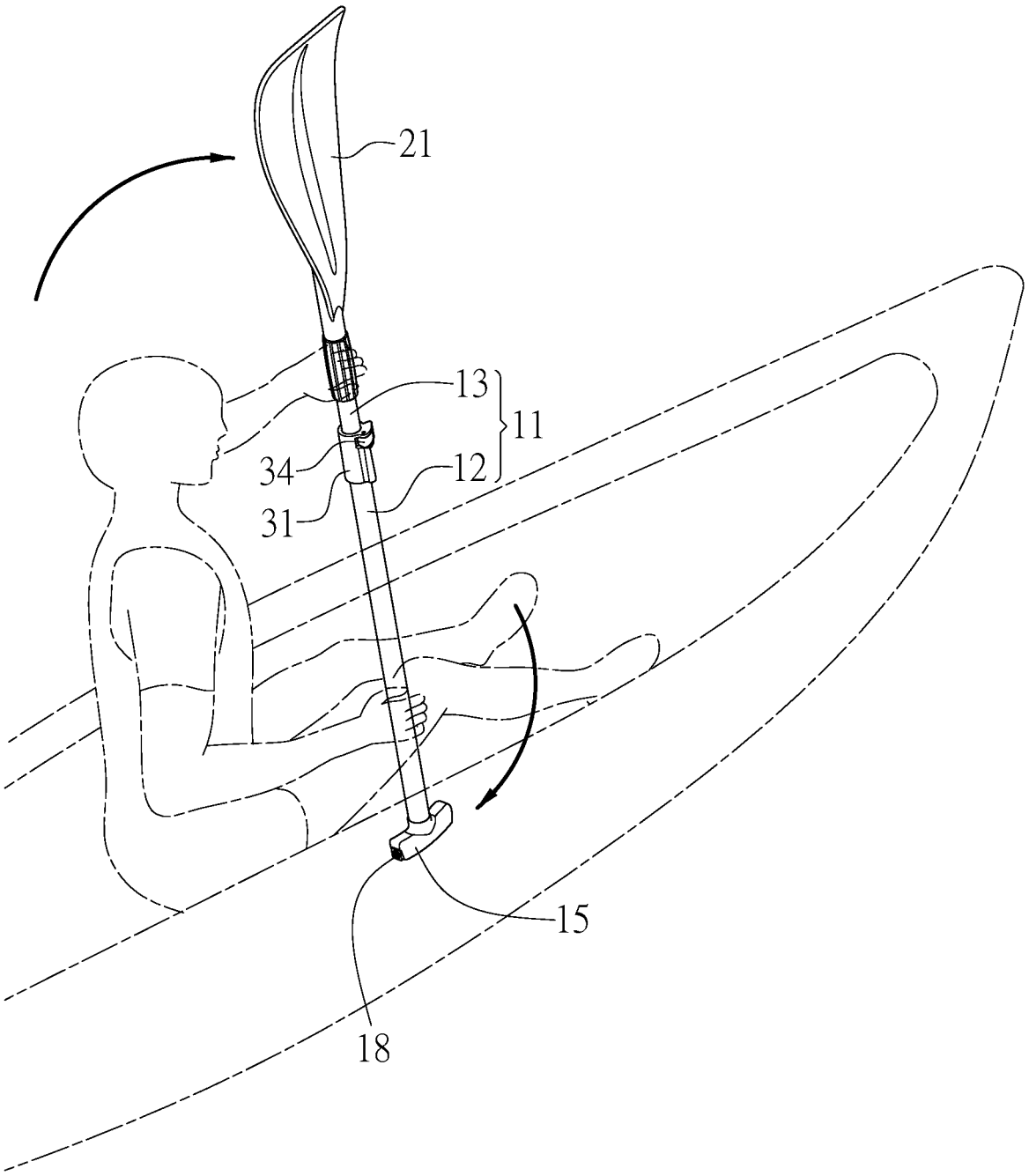
FIG. 6 is a schematic view of the present invention in an operating state.

When the oar 10 composed of the above structure is in actual use, as shown in FIG. 6, the oar 10 is used to row a boat through the water. When there is water in the boat, since the oar 10 provided by the present invention has the bail opening 18 that is disposed on the grip 15 of the oar 10 opposite the oar blade 21, it is only necessary to reverse the oar 10 to make the grip 15 face down when the oar 10 is used for bailing water. This action is ergonomic and has the advantage of easy operation. Referring to FIG. 4, the width d of any periphery of the end face 17 having the bail opening 18 of the present invention is significantly less than the width D of the oar blade 21 in its flared direction. Therefore, the handle 15 can be surely placed into the space confined by the boat's floor, so that the bail opening 18 on the end face 17 of the protruding portion 16 of the grip 15 in a curved shape can bail water easily, having the flexibility to bail water in different spaces. The user only needs to release the pressing action of the fixing device 31 on the inner tube 13, so that the inner tube 13 can be telescopically moved relative to the outer tube 12. As shown in FIG. 7, when the inner tube 13 is pulled by applying a force, the piston 14 is driven to slide along the accommodating room 123. By the change of the volume and pressure of the accommodating room 123 caused by the movement of the piston 14, the bail opening 18 can bail water.

In addition, in the present invention, the bail opening 18 is disposed on the grip 15 of the oar 10 opposite the oar blade 21, which can maintain the integrity and structural strength of the oar blade 21, so that the function of the oar blade 21 is not disturbed by additional components, and the grip 15 having the bail opening 18 can be directly applied to the existing oar blades on the market. There is no need to design the oar blade separately, so it can reduce the manufacturing cost effectively.

Figure 8:
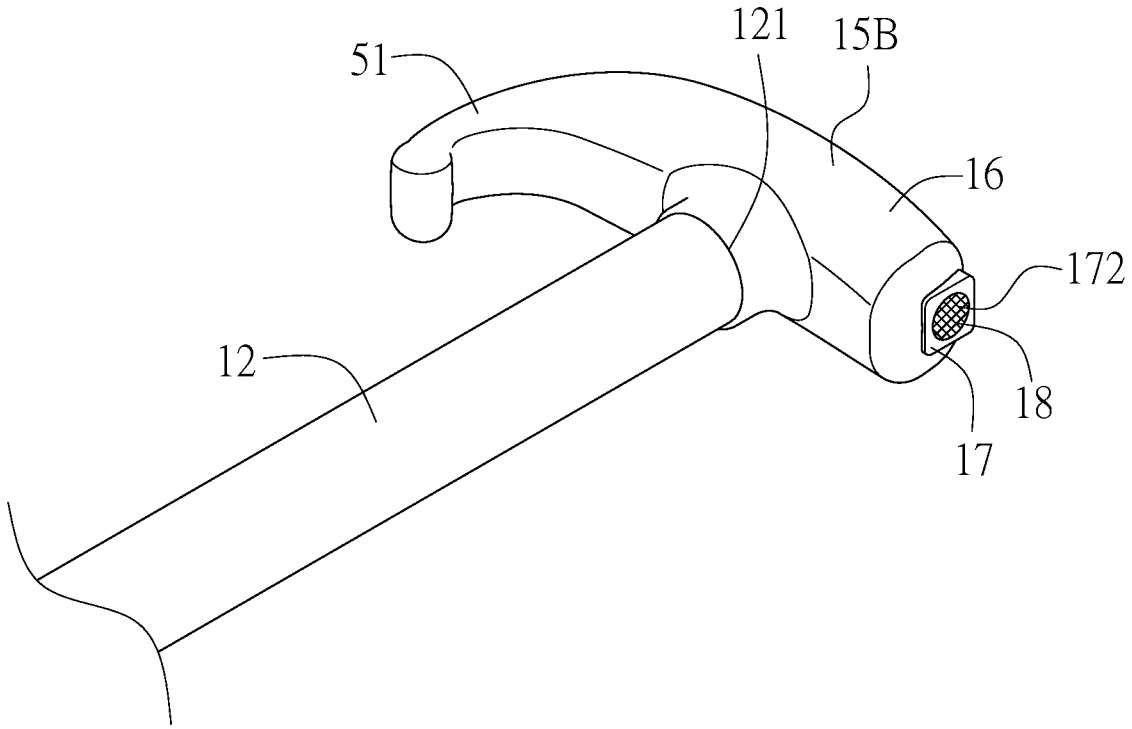
FIG. 8 is a schematic view of another embodiment of the grip of the present invention.

The grip provided by the present invention is not limited to the structural form of the above embodiment. FIG. 8 illustrates another feasible embodiment. The grip 15B also has the protruding portion 16 extending laterally. The bail opening 18 is formed on the end face 17 of the protruding portion 16 facing its extending direction thereof. Another side of the grip 15B, opposite to the protruding portion 16, is bent and extended to form a hook portion 51. In this way, the grip 15B can be used to hook the cable on the dock or the surrounding boat (not shown) to tow the boat.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An oar capable of bailing water, comprising a rod and an oar blade that is flared and connected to one end of the rod, the rod including an outer tube and an inner tube that are insertedly connected to each other to form a pump structure capable of performing a telescopic movement, a fixing device being provided at a junction of the outer tube and the inner tube, the rod having an accommodating room therein, the accommodating room being provided with a piston that can slide along the accommodating room with the telescopic movement of the rod, characterized in that:

another end of the rod, opposite to the oar blade, is formed with a bail opening communicating with the outside, a passage being defined between the bail opening and the accommodating room, and the passage communicates with the bail opening and the accommodating room.

2. The oar capable of bailing water as claimed in claim 1, wherein the another end of the rod, opposite to the oar blade, is provided with a grip, the grip has a protruding portion extends laterally, the bail opening is formed on an end face of the protruding portion facing an extending direction of the protruding portion, and the passage is bent and disposed inside the grip to communicate with the bail opening and the accommodating room.

3. The oar capable of bailing water as claimed in claim 2, wherein the outer tube has a hollow tubular shape with two open ends defined as a coupling end and a receiving end, the grip is disposed at the coupling end, the accommodating room is formed in the outer tube, the inner tube having a first end and a second end, the first end of the inner tube is slidably inserted into the accommodating room via the receiving end of the outer tube, the first end is provided with the piston, and the oar blade is connected to the second end of the inner tube.

4. The oar capable of bailing water as claimed in claim 3, wherein the second end of the inner tube is coaxially connected with a hollow sleeve, the sleeve is formed with a positioning hole along a radial direction thereof, the oar blade has a joint portion that is inserted into the sleeve, and the joint portion is provided with a resilient member that is resiliently engaged with the positioning hole.

5. The oar capable of bailing water as claimed in claim 2, wherein another side of the grip, opposite to the protruding portion, is bent and extended to form a hook portion.

6. The oar capable of bailing water as claimed in claim 2, wherein the fixing device is disposed on the receiving end of the outer tube, the fixing device has an extension interface that is coaxially disposed with the receiving end, the first end of the inner tube is inserted into the accommodating room via the extension interface and the receiving end of the outer tube, the fixing device is formed with a groove communicating with the extension interface, a positioning member is pivotally connected to the groove, and one end of the positioning member is formed with an abutting portion that is configured to press against the inner tube.

7. The oar capable of bailing water as claimed in claim 1, wherein the bail opening is covered with a mesh filter.

* * * * *